US005553862A

United States Patent [19]

Konotopsky

[11] Patent Number: 5,553,862

[45] Date of Patent: Sep. 10, 1996

[54] TOSS GAME APPARATUS

[76] Inventor: William Konotopsky, 2797-13 Ave. S.E., Medicine Hat, Alberta, Canada, T1A 3P7

[21] Appl. No.: 318,242

[22] Filed: Oct. 5, 1994

[51] Int. Cl.[6] ..... A63B 67/06

[52] U.S. Cl. ..... 273/402

[58] Field of Search ..... 273/402, 398, 273/400, 401

[56] References Cited

U.S. PATENT DOCUMENTS

| | | | |
|---|---|---|---|
| 4,243,229 | 1/1981 | Huser et al. | 273/402 |
| 5,050,889 | 9/1991 | Walker | 273/402 |
| 5,056,797 | 10/1991 | Hockert et al. | 273/402 |

*Primary Examiner*—William H. Grieb
*Attorney, Agent, or Firm*—G. F. Gallinger

[57] ABSTRACT

A washer toss game apparatus is disclosed comprising: 1) a planar member having a hole through a central portion thereof; and, 2) an upright support member which has three lateral grooves through a central portion thereof, each which closely fits an edge of the planar member. The planar member accordingly may be positioned at three different levels of inclination. The planar member is additionally provided with a non-slip resilient planar strip on one side thereof, so that when this side is positioned upwardly the washers are more easily tossed and maintained on the planar surface. By increasing the angle of inclination of the planar member and turning the slippery side upwards the difficulty of scoring can be increased. Each player alternatively tosses four washers in a round. All washers of one player which are closer to the hole than any of the washers of the other player score points. Three points are awarded for a washer passing through the hole; one point for other scoring washers. Additional rounds are played until one side achieves and wins with 21 points.

4 Claims, 1 Drawing Sheet

TOSS GAME APPARATUS

BACKGROUND OF THE INVENTION

This invention relates to ring toss gains and more particularly to such gamess which can be progressively increased in difficulty as the game player becomes more adept and skilled in the use thereof.

Numerous tossing games have been disclosed in the prior art, The problem with all of these games is that they are not adaptable to the skill of the player. Once a player becomes adept in the use thereof there is no means provided whereby the parameters of the game may be varied so that increasing skill is required to successfully play the game.

OBJECTS AND STATEMENT OF INTENTION INVENTION

It is an object of this invention to provide a game in which the physical parameters may be varied in order to maintain a challenge to a player as he becomes more skillful. It is an object of this invention to provide a toss game which requires the player to vary his throwing strategy to optimize scoring under varying parameters. It is yet a further object of this invention to provide a game which is durable, versatile, and in which the physical parameters may be easily varied within the general rules for the game.

One aspect of the invention provides for an apparatus for a toss game used on a playing surface comprising: a planar member having opposite planar sides, opposite edge portions, one of which rests on the playing surface, and a hole through a central portion thereof between the opposite sides; and, an upright edge support member having a lower end portion seated on the playing surface and a central portion connected to the edge portion of the planar member opposite that which rests on the playing surface, so that the planar member is held in an inclined position, said upright edge support member having a horizontal lateral groove partially therethrough across a central portion thereof, said groove adapted to closely receive the edge portion of the planar member opposite that which rests on the playing surface.

A preferred aspect of this invention provides for a game having three lateral grooves within the central portion of the upright member so that the planar member may be positioned in differing inclinations. Steeper inclinations make the game more difficult. Additionally the planar member has two planar sides each having differing coefficient of friction. With the more slippery side up it is more difficult to maintain a tossed washer on the planar surface. With a shock absorbing, more sticky side of the planar member turned up, tossed washers are more easily positioned and maintained on the planar member.

Other objects, advantages and features of this invention will become apparent to those skilled in the art from the following discussion, taken in conjunction with the accompanying drawings, in which:

FIGURES OF THE INVENTION

Figure 1:
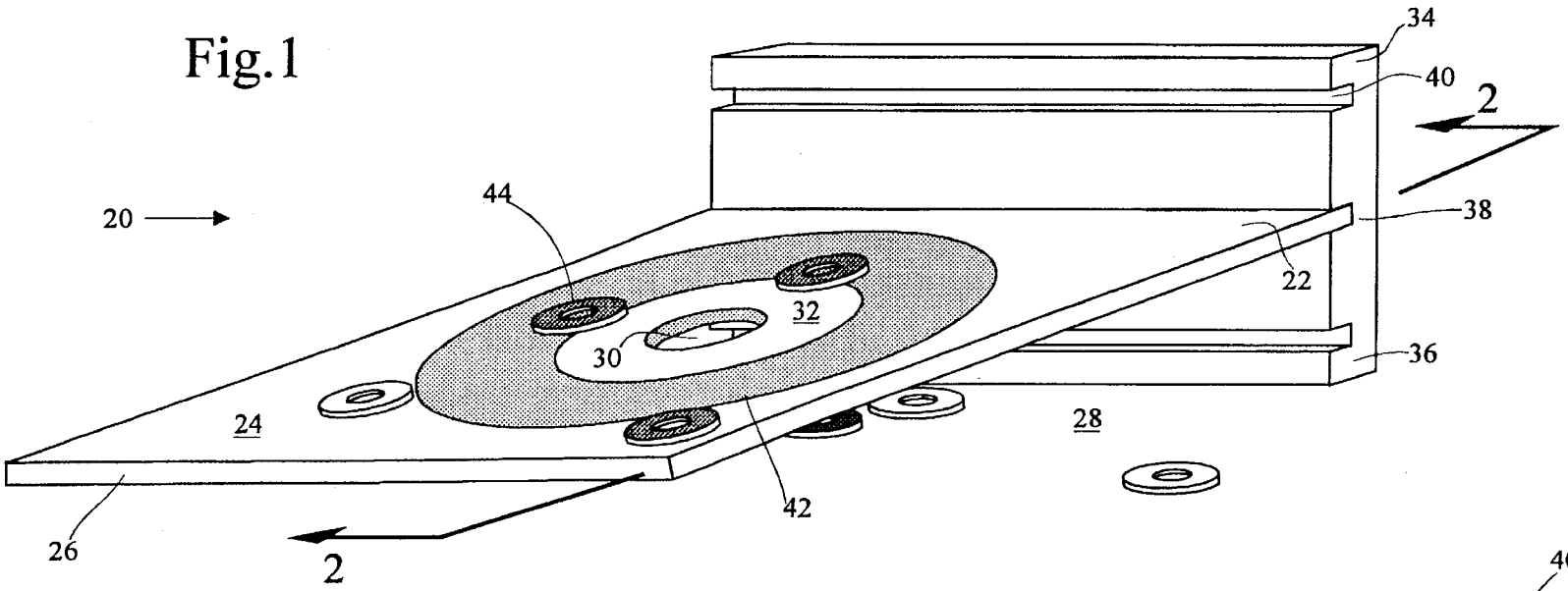
FIG. 1 is a perspective view of the toss game apparatus.

The following is a discussion and description of the preferred specific embodiments of this invention, such being made with reference to the drawings, whereupon the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1, we have a perspective view of the toss game apparatus 20. The apparatus 20 comprises: a rectangular planar member 22 having opposite planar sides 24, opposite edge portions 26, one of which rests on the playing surface 28 and a hole 30 through a central portion 32 thereof between the opposite sides 22; and, a rectangular upright support member 34, having a lower end portion 36 seated on the playing surface 28. The central portion 38 of the upright support member 34 is connected to an edge portion 26 of the planar member 22 opposite that which rests on the playing surface 28. The planar member 22 is thereby held in an inclined position.

The upright support member 34 is connected to the planar member 22 by means of one of three horizontal lateral grooves 40 which is partially therethrough across a central portion of the upright support member 34. Each groove 40 is adapted to closely receive the edge portion 26 of the planar member 22. The connection is a releaseable connection to facilitate transportation, storage, and varying of the inclination of the planar member 22. The planar member 22 and upright member 34 may be made of wood or plastic. The game may be played out-of-doors or inside. The rectangular upright support member 34 extends above the planar sides 24 of the planar member 22 so that it may be used as a back board in the toss game.

The planar sides 24 of the planar member 22 are provided with rings 42 marked thereon which are concentric about the center of the hole, to facilitate comparing radial distances of washers 44 tossed thereon.

Figure 2:
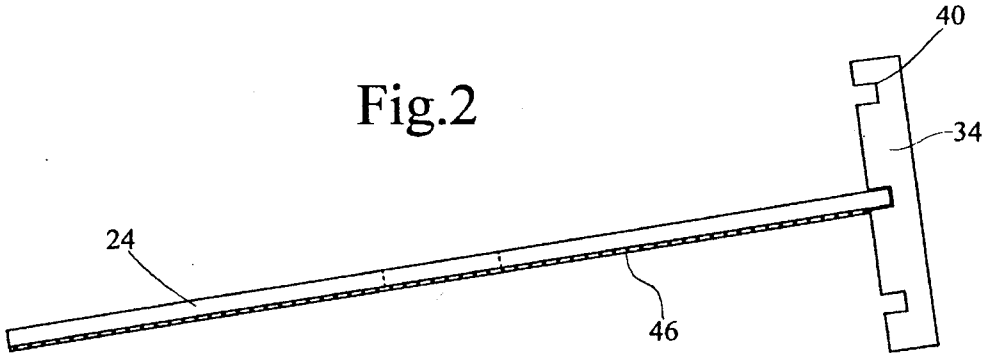
FIG. 2 is a side view of the game apparatus shown in FIG. 1 taken along lines 2—2 of FIG. 1.
Figure 3:
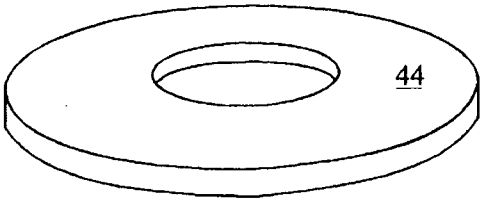
FIG. 3 is a full size perspective view of a metallic flat washer similar to those shown in FIG. 1.

Looking at FIG. 2, a side view of the apparatus 20 we see a foam planar strip 46 adhered to one planar side 24 of the planar member 22. The strip 46 is made from a resilient rubber. When the planar member 22 is reversed so that the strip 46 is turned upward, then it is much easier to maintain the washers 44 on the planar sides 24 after they are tossed thereon.

It is suggested that players began playing with the strip 46 turned upwardly and the planar member 22, in the lowest groove 44. With minimal inclination on the planar side and the shock absorbing, high coefficient friction strip 46 turned upwards it will maximize the probability of maintaining a washer 44 on the planar side 24 and thereby scoring. The washers 44 are 2½ in diameter and the hole 30 is 2¾ in diameter so that it is fairly difficult to toss the washers 44 through the hole 30.

PLAYING THE GAME

Two players are each provided with four washers 44. One of the player's washers 44 are marked, preferably with red paint, to distinguish them from the washers 44 of the other player. In the preferred embodiment one set of four washers 44 is red; the other set of four washers 44 is black. The players alternatively throw their set of washers 44 aiming to drop each washer 44 through the hole 30, and attempting to at least land and maintain the washer 44 on the planar surface 24 as closely as possible to the center of the hole 30.

Two toss game apparatuses 20 are placed 12 feet apart and the players must toss the washers 44 from behind a throw line which is defined to be at the edge 26 of the planar member 22 which is on the playing surface 28.

The object of the game is to be the first player, or team of two players, to obtain 21 points. Three points are awarded for passing a washer 44 through the hole 30. All washers 44 of one color that are closer to the hole 30 than any of the other washers 44 of the other color additionally score 1 point each. A round is defined to be each player or team tossing four washers 44. On any one round only one team or player can collect points. If two differently colored washers 44 are tossed through the hole 30 then they cancel each other out, and scoring is determined by the washers 44 on the planar surface 24. Any washer 44 that bounces off the playing surface 28 and onto the planar surface 24 is disqualified and removed immediately.

For example, looking at FIG. 1, two differently colored washers 44 have been tossed through the hole 30 and they cancel each other. Black then scores three points, one point each for each of the black washers 44 which are on the planar member, because each of these three washers 44 on the planar surface 24 is closer to the center of the hole 30 than any of the other differently marked washers 44.

While the invention has been described with preferred specific embodiments thereof, it will be understood that this description is intended to illustrate and not to limit the scope of the invention, which is defined by the following claims.

I claim:

1. An apparatus for a toss game used on a playing surface comprising:

a planar member having opposite planar sides, opposite edge portions, one of which rests on the playing surface, and a hole through a central portion thereof between the opposite sides;

an upright edge support member having a lower end portion seated on the playing surface and a central portion connected to the edge portion of the planar member opposite that which rests on the playing surface, so that the planar member is held in an inclined position, said upright edge support member having a horizontal lateral groove partially therethrough across a central portion thereof, said groove adapted to closely receive the edge portion of the planar member opposite that which rests on the playing surface;

said upright support member having two or more lateral grooves arranged at differing heights so that the planar member may be inclined therefrom at differing angles of inclination;

and wherein the opposite planar sides of the planar member have differing coefficients of friction so that when the more slippery side is turned upwardly it is more difficult to maintain the washers thereon.

2. An apparatus as in claim 1 wherein there are three lateral grooves.

3. An apparatus as in claim 1 wherein the side of the planar member having the highest coefficient of friction comprises a resilient plastic planar member fastened thereto.

4. An apparatus as in claim 1 wherein rings concentric about the center of the hole are provided on the planar member to facilitate comparing radial distances of washers tossed thereon.

* * * * *